United States Patent [19]

Okamura et al.

[11] 4,449,838

[45] May 22, 1984

[54] INK RIBBON CASSETTE FOR PRINTER

[75] Inventors: Yasushi Okamura; Harukazu Manabe; Norihide Sato, all of Fukuoka, Japan

[73] Assignee: Matsushita Electric Industrial Co., Ltd., Kadoma, Japan

[21] Appl. No.: 402,806

[22] Filed: Jul. 28, 1982

[51] Int. Cl.[3] ..... B41J 32/02; B41J 35/08

[52] U.S. Cl. ..... 400/234; 400/208; 400/196.1; 400/202.4

[58] Field of Search ..... 400/196, 196.1, 200, 400/202.4, 208, 234

[56] References Cited

U.S. PATENT DOCUMENTS

| | | | |
|---|---|---|---|
| 2,969,865 | 1/1961 | Long | 400/200 |
| 3,356,202 | 12/1967 | Goff, Jr. | 400/234 |
| 4,091,914 | 5/1978 | Stipannk | 400/208 |
| 4,153,378 | 5/1979 | Scherrer et al. | 400/200 |
| 4,273,453 | 6/1981 | Haftmann | 400/202.4 |
| 4,300,847 | 11/1981 | Hoffman | 400/196.1 |
| 4,307,969 | 12/1981 | Daughters | 400/208 |

FOREIGN PATENT DOCUMENTS

| | | | |
|---|---|---|---|
| 2550305 | 5/1977 | Fed. Rep. of Germany | 400/202.4 |
| 2935027 | 3/1981 | Fed. Rep. of Germany | 400/234 |
| 56-77180 | 6/1981 | Japan | 400/234 |
| 2081220 | 2/1982 | United Kingdom | 400/234 |

OTHER PUBLICATIONS

Firth et al., "Web Retention Spring", IBM Technical Disclosure Bulletin, vol. 22, No. 6, p. 2386, 11/79.

*Primary Examiner*—William Pieprz

*Attorney, Agent, or Firm*—Cushman, Darby & Cushman

[57] ABSTRACT

An ink ribbon cassette for impact type printers comprises an ink roller of plastic sponge impregnated with ink and an endless type ink ribbon contacting with the ink roller. The ink ribbon is provided with a proper tension by a leaf spring member. At the time of assembly, the pressure of the leaf spring on the ribbon is not yet impressed. After the setting of ribbon, the bow-shaped leaf spring is reversed to opposite side in a snap action, being pushed from the outside, thereby to impress the tension. In another example, when the ink volume impregnated in the ink ribbon decreases after long use of the cassette, pressure is applied to the ink roller by the spring member, by changing the side of it bow part and squeezing ink to transfer to the ink ribbon, thereby prolonging the service time of the ink ribbon.

8 Claims, 6 Drawing Figures

INK RIBBON CASSETTE FOR PRINTER

BACKGROUND OF THE INVENTION

1. Field of the Invention

This invention relates to an ink ribbon cassette for impact type printers such as a typewriter or a wire-dot printer.

2. Description of the Prior Art

An ink ribbon cassette to be used for the impact type printers such as a typewriter or a wire-dot printer usually contains in its case an endless type ink ribbon which is held between a pair of knurled rollers which drive the ribbon by means of friction. The volume of ink being limited to the volume impregnated in the ink ribbon beforehand, long term use can not be hoped for. In order to remedy this shortcoming, there are ink ribbon cassettes made with an ink roller made of an ink soaked plastic sponge installed in its case, to which the ink ribbon is made to contact while in use for printing.

In this case, only the limited quantity of ink that was impregnated in the ink roller could be fed to the ink ribbon, which resulted in failure to sufficiently attain the intended long term use. In another prior art, in order to give a proper tension to the ribbon, a leaf spring was provided as a friction member to keep the ribbon pressed to the inner surface of the case. At the time of manufacture in this case, the tape had to be set in position to get through the gap between the spring and the case by holding the spring in bended state in resistance to its elastic strength. This necessitates a critical production step of placing the ribbon to get through the passage while holding the spring in bended condition.

SUMMARY OF THE INVENTION

The present invention purports to provide an improved ink ribbon cassette for impact type printers such as a typewriter or a wire-dot printer, wherein ink of the ribbon can be used for longer term than the conventional cassette. The ink ribbon cassette in accordance with the present invention comprises an ink roller made of plastic sponge which is impregnated with ink and an endless type ink ribbon, the ink ribbon turning round making contact with an ink roller, the ink ribbon being provided with a proper tension by a bow-shaped leaf spring member, as a pressing force switching device, mounted for applying the friction to the ribbon by pressing it; at the time of assembly, the ink ribbon is set in position in the ribbon passage of the cassette with the pressure of the leaf spring on the ribbon being kept away, and after the setting of ribbon, the bow part of the spring changes side in a snap action, being pushed to the opposite side. In other embodiment, it is also possible to provide a spring at a position opposite to the contact point of the ink roller with the ink ribbon, by which, when the ink volume impregnated in the ink ribbon decreases after long term use of the cassette, pressure is applied to the ink roller by the spring member, as a pressing force switching device, taking advantage of its snap action of changing the side of its bow part for squeezing ink out of the ink roller, to transfer ink from the roller to the ink ribbon.

DESCRIPTION OF PREFERRED EMBODIMENTS

Figure 1:
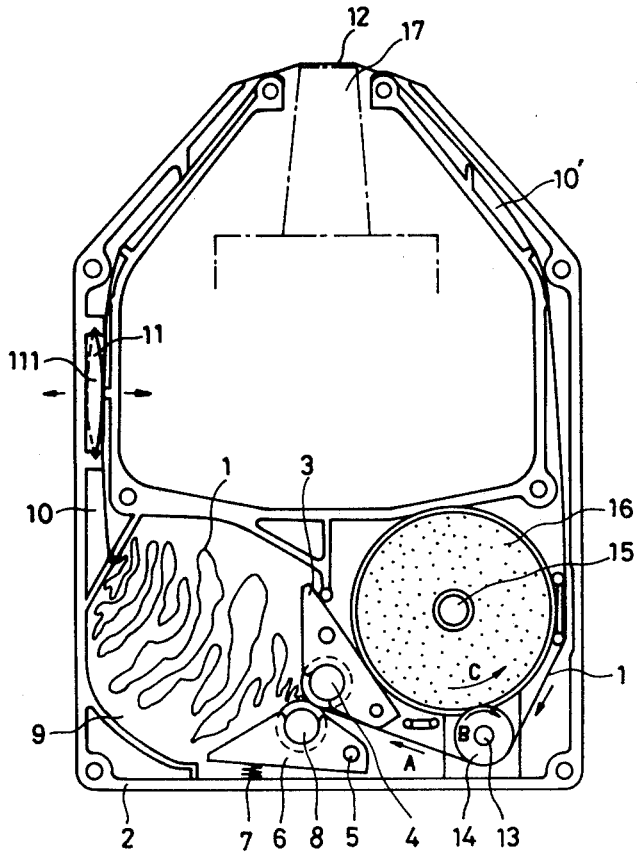
FIG. 1 is a sectional plan view of the ink ribbon cassette of this invention.

In FIG. 1, an endless ink ribbon 1 is contained in an ink ribbon cassette 2, and is drivingly held by a driving roller 4 with a knurled face to be rotated by a driving means (not shown) and a pinch roller 8 with a knurled face. The driving roller 4 is journaled on a support member 3 which is fixed in the ink ribbon cassette 2. The pinch roller 8 is journaled on a cradling support member 6, which is fulcrumed by a pin shaft 5 in the ink ribbon cassette 2 and energized by a pressure spring 7 so as to press the pinch roller 8 to the driving roller 4. By turning of the driving roller 4, the ink ribbon 1 is pulled into a ribbon storing space 9 by the above-mentioned two rollers 4, 8. The ink ribbon 1 is pulled out of the other side of the ribbon storing space 9, and is guided through the passage 10. The ink ribbon 1 is given proper tension by a press spring 11 which is a snap action leaf spring which changes its bow side in relation to the span line to apply or not to apply tension on the ink ribbon. The leaf spring is a compression spring of a bow shape, fixed in an oblong ribbon path room at its both ends, and has a first bow shaped stable position which is apart from the ink ribbon and a second bow shaped stable position which is reverse to the first bow shaped stable position wherein the smooth convex face of the leaf spring is pressing the ink ribbon without damaging the ink ribbon. And then, the ink ribbon runs horizontally of FIG. 1 through a printing work position 12 to proceed into the passage 10'. An ink-transfer roller 14 which is journalled on the shaft 13 rotates in arrow-marked direction B as the ink ribbon 1 runs in arrow-marked direction A. The ink-transfer roller 14 also turns the ink-impregnated roller 16 which is made to rotate freely on the fixed shaft 15, in direction indicated by arrow C which is molded in as one unit with the ink cassette, being press-contacted with each other. This ink-impregnated roller 16 is made of felt or other fibrous material or porous rubber or plastic material which can store ink. By the rotation of this ink-impregnated roller 16, the ink in the ink-impregnated roller 16 will be fed to the ink ribbon 1 via the ink-transfer roller 14. The ink ribbon 1 is sent into the ink ribbon storing space 9 after having been fed with ink, by means of the drive roller 4 and the pinch roller 8, being pressheld between the two gears. As explained above, by providing a snap action spring member 11, and taking advantage of its snap action for changing the side of its bow, a proper tension can be given to the ink ribbon. At the time of assembling the ink ribbon cassette, prior to leading ink ribbon 1 into the ribbon passage, the spring member 11 fixed at its two ends with its bow side can be held in with its bow side to the opposite side (the state given in broken line) to keep the passage open for the ribbon. After the ink ribbon is set into the ribbon passage, the spring is snap-pushed onto the ribbon (the state given in solid line), to give a proper tension to the ribbon. Consequently, the handling of the ink ribbon, especially its setting in place is simple, thus contributing to the improved efficiency in the assembling of the cassette 2. As for the form of the spring member, there can be various variations without deviation from the basic idea as mentioned above.

Figure 2:
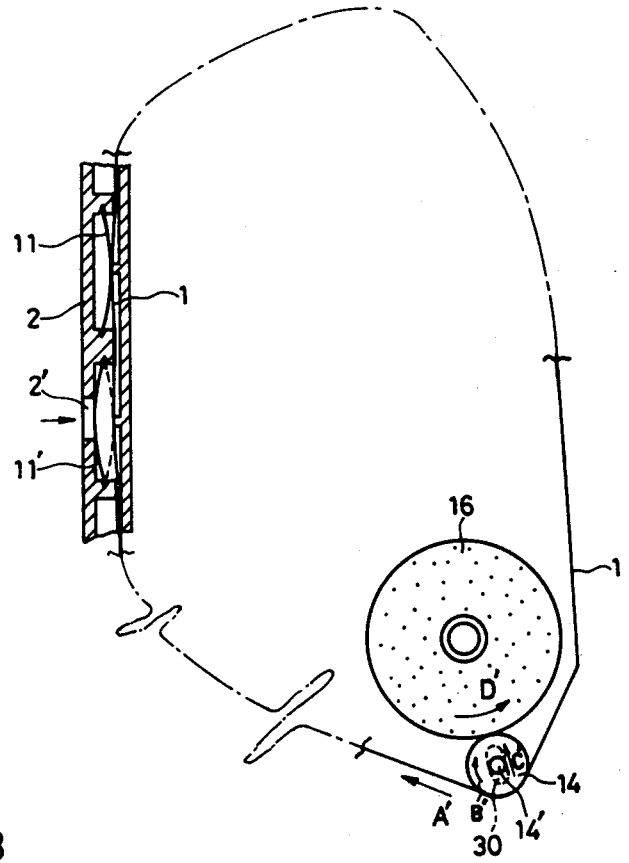
FIG. 2 is an enlarged sectional view of a particular portion in a second example of embodiment of this invention.
Figure 3:
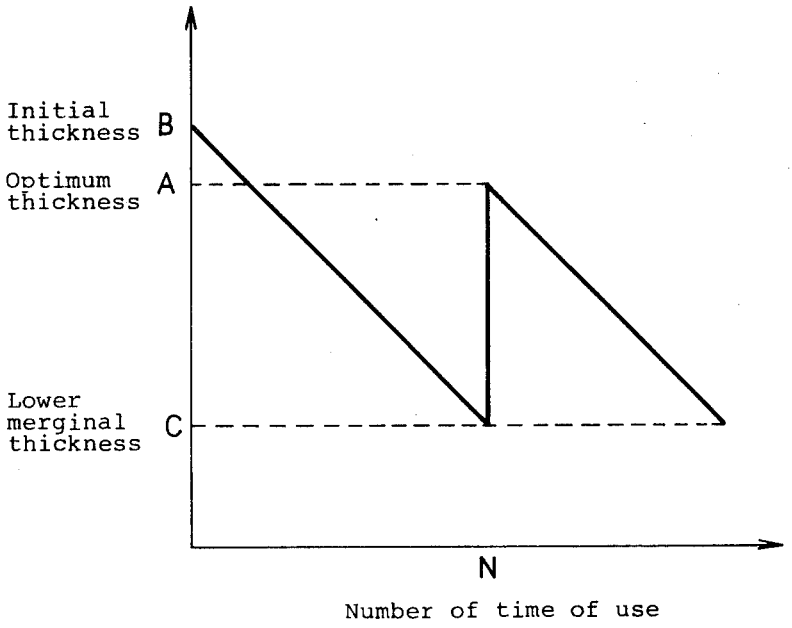
FIG. 3 is a graph which shows the characteristic of this invention.

FIG. 2 shows a second example of embodiment of this invention. In this example, a first spring member 11 is arranged in series with a second spring member 11' in the ink ribbon cassette 2, and an opening 2' is provided at a position to expose the spring member therefrom. Thereby, a proper tension is given to the ink ribbon 1 by means of the first spring member 11 for printing. When the volume of ink impregnated in the ink roller 16 decreases and the printing becomes too light, the second spring 11' is pushed with a slender thing such as a tip of a pin, etc., through the opening 2' of the cassette 2, so that the bow side of spring 11' is reverted in a snap action to the opposite side and press the ink ribbon 1 to the inner side of the ink ribbon cassette 2. By this action of the springs 11 and 11', a strong friction is bestowed to the ink ribbon 1. At this time, by forming an oblong opening on the upper lid of ink ribbon cassette for engaging shaft of the transfer roller 14, said roller 14 can be driven in the direction C. This gives contact of the transfer roller 14 with the ink roller 16, thereby squeezing the ink impregnated in the ink roller 16 by the ink-transfer roller 14, raising the printing density of printing ink in the ribbon 1. FIG. 3 shows a curve of such characteristic. In other words, as shown in FIG. 3, the initial degree of ink quantity contained in the ribbon is set at a thickness level B which is higher than the optimum thickness level A. With the increase in the numbers of time N in use of the ribbon, the degree of thickness of ink is lowered to the lower marginal thickness (lower limit) level for legibility. By pressing the tension spring 11', ink is fed to the ribbon from the ink transfer roller 14 with the result that the level of ink thickness of the ribbon is recovered to the optimum level A.

Figure 4:
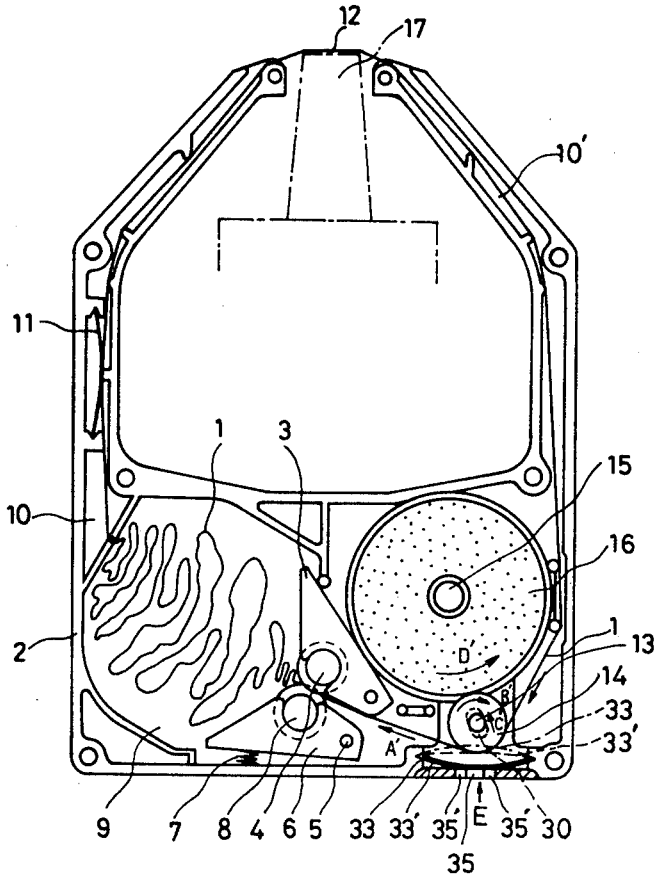
FIG. 4 is a sectional plan of the ink ribbon cassette of a third example of this invention.
Figure 5:
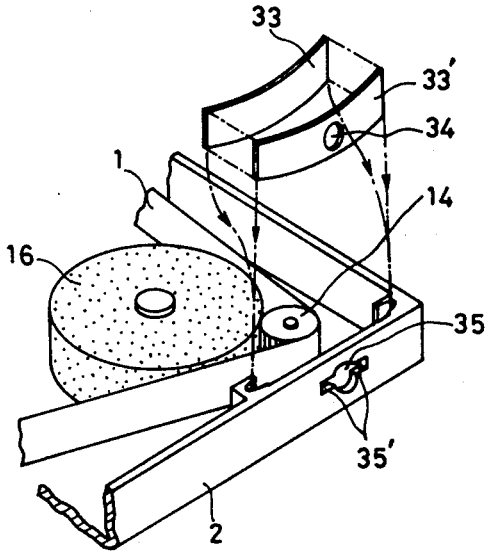
FIG. 5 is an exploded perspective view of the third example.
Figure 6:
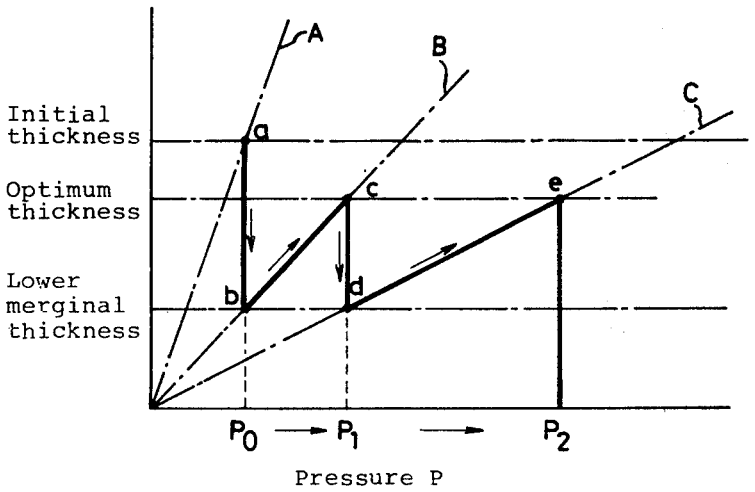
FIG. 6 is a graph which shows the characteristics of a third example of this invention.

FIG. 4, FIG. 5 and FIG. 6 show third examples of embodiment of this invention. Most parts are configurated identical with the foregoing examples, but a snap motion squeezing means is provided at the transfer roller 14. The ink ribbon 1 of endless type is contained in the ink ribbon cassette 2 and is drivingly held by a driving roller 4 with a knurled face to be rotated by a driving means (not shown) and a pinch roller 8 with a knurled face. The driving roller 4 is journalled on a support member 3 which is fixed in the ink ribbon cassette 2. The pinch roller 8 is journalled on a cradling support member 6, which is fulcrumed by a pin shaft 5 in the ink ribbon cassette 2 and energized by a pressure spring 7 so as to press the pinch roller 8 to the driving roller 4. By turning of the driving roller 4, the ink ribbon 1 is pulled into a ribbon storing space 9 by the above-mentioned two rollers 4, 8. The ink ribbon 1 is pulled out of the other side of the ribbon storing space 9, and is guided through the passage 10. Proper tension is given to the ink ribbon 1 by a press spring 11 which is a bistable snap action leaf spring which changes its bow side in relation to the span line to apply or not to apply tension on the ink ribbon. The leaf spring is a compression spring of a bow shape, fixed in an oblong ribbon path room at its both ends, and has a first bow shaped stable position which is apart from the ink ribbon and a second bow shaped stable position which is reverse to the first bow shaped stable position wherein the smooth convex face of the leaf spring is pressing the ink ribbon without fear of damaging the ink ribbon. And then, the ink ribbon runs horizontally of FIG. 1 through a printing work position 12 to proceed into the passage 10'. An ink-transfer roller 14 which is journalled on the shaft 13 rotates in arrow-marked direction B' as the ink ribbon 1 runs in arrow-marked direction A'. The shaft 13 of the ink transfer roller 14 is borne slidable in a direction shown by an arrow C' in FIG. 4, so that amount of the ink transfer from the ink-impregnated roller 16 to the ink transfer roller 14 increases as the shaft 13 is moved towards the shaft 15 of the ink-impregnated roller 16. The ink-transfer roller 14 also turns the ink-impregnated roller 16 which is made to rotate freely on the fixed shaft 15, which is molded in as one unit with the ink cassette, being press-contacted with each other, in arrow-marked direction D'. This ink impregnated roller 16 is made of felt or other fibrous material or porous rubber or plastic material which can store ink. By the rotation of this ink-impregnated roller 16, the ink in the ink impregnated roller 16 will be fed to the ink ribbon 1 via the ink-transfer roller 14. The ink ribbon 1 is sent into the ink ribbon storing space 9 after having been fed with ink, by means of the drive roller 4 and the pinch roller 8, being pressheld between the two gears. As explained above, by providing a snap action spring 11, and taking advantage of its snap action for changing the side of its bow, a proper tension can be given to the ink ribbon. At the time of assembling the ink ribbon cassette, prior to leading ink ribbon 1 into the ribbon passage, the spring member 11 fixed at its two ends with its bow side can be held in with its bow side to the opposite side (the state given in broken line) to keep the passage open for the ribbon. After the ink ribbon is set into the ribbon passage, the spring is snap-pushed onto the ribbon (the state given in solid line), to give a proper tension to the ribbon. Consequently, the handling of the ink ribbon, especially its setting in place is simple, thus contributing to the improved efficiency in the assembling of the cassette 2.

Explanation is given here on the relation between the volume of ink to be transferred from the ink impregnated roller 16 to the ink ribbon 1 which is the ink thickness level of printer and the contact pressure on the ink impregnated roller 16 by the transfer roller 14. FIG. 6 shows the relations of thickness level of ink (that is the volume of ink transferred to the ink ribbon 1) and the contact pressure on the ink impregnated roller 16 by the transfer roller 14. In FIG. 6, as the pressure P on the ink impregnated roller 16 by the ink-transfer roller 14 is increased, the printing ink thickness level shows an increase like curve A in the initial stage. The volume of ink decreases after one million letters having been printed, in the ink impregnated roller by 20–30% which is shown by curve B. Now, if $P_0$ is taken as the contact pressure force of the ink-transfer roller on the ink-impregnated roller, the coordinate of operation is at point "a" in the initial stage. As the numbers of letters that are printed increase, the ink thickness will become optimum, and after one million letters are printed, the printing will become less clear to the marginally legible level, when the print-out ink thickness comes down to point "b" on the curve B. At this stage, the ink is still retained about 50% of the initial volume in the ink-impregnated roller 16. If the contact pressure $P_0$ is raised by some means, it is evident that print-out ink thickness level will rise from the point "b" along the curve B to the condition of point "c", to recover the optimum condition.

In the example shown in FIG. 4 of this invention, double press-springs 33 and 33' of the snap action leaf springs as shown in FIG. 5 are provided in front of the transfer roller 14, and through-holes 34 and 35 are formed on the outer spring 33' and a front wall of the casing 2, respectively. Accordingly, by pushing the inner spring 33 with a slender item such as a pen through the hole 35 on the casing 2 and the hole 34 in a direction of arrow E, a snapping turn of the bow-side of the inner spring 33 to the state as shown by the broken line is attained thereby producing an additional force ($P_1$–$P_0$ of FIG. 6) as required for recovering the optimum thickness of ink in the print-out in addition to the running tension $P_0$ by the ink ribbon. By means of such a simple mechanism, the ink thickness can be recovered. There are various kinds of variation as to the form of the spring member here referred to. They can be made without deviating from the basic idea. After the printing of one million letters, the ink volume contained in the ink impregnated roller 16 will decrease by about 30 to 50% of the original quantity, bringing the coordinate of the operation point in FIG. 6 to the point "d". If, at this stage, the outer pressure spring 33' is pushed in the direction of arrow-mark E through a widened side grooves 35' which is formed on side part of the through-hole 35, the pressure spring 33 will change its bow side, and therefore, a pressure force $P_2$–$P_1$ will be additionally applied, bringing the print-out ink thickness recovered to the point e in FIG. 6, which will enable additional printing of one million letters further.

What is claimed is:

1. An ink ribbon cassette including:

an ink ribbon, an ink-impregnated body, an ink transfer roller turned by contact friction with the running of said ink ribbon, thereby making contact of said ink transfer roller with said ink ribbon and said ink-impregnated body to transfer ink from said ink-impregnated body via said ink transfer toller to said ink ribbon, the improvement comprising:

at least one pressing force switching device movable between a pressing state and a non-pressing state for changing the pressing force applied to said ink ribbon said switching device being located in a narrow ink ribbon path wherein said ink ribbon is pressed by said pressing force switching device when said switching device is in a pressing state, said cassette further comprises a pressing force device provided in sequence with said pressing force switching device, said cassette having a wall, said wall having a hole for receiving a tool insertable therethrough, said hole being adjacent said switching device for exposing said pressing force switching device to be moved by said tool for moving said pressing force switching device between said pressing and said non-pressing states.

2. An ink ribbon cassette comprising:

an ink ribbon, an ink-impregnated body, an ink transfer roller turned by contact friction with the running of said ink ribbon, thereby making contact of said ink transfer roller with said ink ribbon and said ink-impregnated body to transfer ink from said ink-impregnated body via said ink transfer roller to said ink ribbon, the improvement comprising:

at least one pressing force switching device is provided in front of said ink transfer roller, thereby to apply a pressing force to said ink transfer roller to press it against said ink-impregnated body wherein said pressing force switching device comprises two bow-shaped snap action leaf springs both disposed superimposed one on the other and held by substantially the same fulcrum points, a casing in front of said two bow-shaped snap action leaf springs having a first switching hole, and the outer one of said two-shaped snap action leaf springs has a second switching hole which is smaller than said first switching hole.

3. An ink ribbon cassette in accordance with claim 1 or 2 wherein said pressing force switching device is a leaf spring of a predetermined length which is fulcrumed at both ends thereof by a pair of fulcrums disposed with an interval shorter than the predetermined length.

4. An ink ribbon cassette in accordance with claim 1 or 2, wherein said pressing force switching device is a leaf spring of a predetermined length which is fulcrumed at both ends thereof by a pair of fulcrums disposed with an interval shorter than the predetermined length, said leaf spring being a compression spring of a bow-shape having a first bow-shaped stable position which is spaced from said ink ribbon and a second bow-shaped stable position which is for pressing said ribbon by a smooth bow-shaped convex face thereof.

5. An ink ribbon cassette comprising:

an ink ribbon, an ink-impregnated body, an ink transfer roller turned by contact friction with the running of said ink ribbon, thereby transmitting the movement of said ink ribbon to said ink-impregnated body and making contact of said ink transfer roller with said ink ribbon and said ink-impregnated body to squeeze said ink-impregnated body and to transfer ink from said ink-impregnated body via said ink transfer roller to said ink ribbon, a pressing means for giving tension to said ink ribbon so as to give a contact pressure by said ink transfer roller to said ink-impregnated body, the improvement comprising:

at least one pressing force switching device for changing the pressing force of said ink transfer roller against said ink-impregnated body being provided wherein said pressing force switching device is a snap-action spring member located within said cassette and movable between a non-pressing state and a pressing state and access means for moving said spring member from said nonpressing state to said pressing state from outside of the cassette.

6. An ink ribbon cassette in accordance with claim 5 further comprising a driving gear for giving pulling force to said ink ribbon in cooperation with said pressing means, wherein said pressing force switching device is disposed next to said pressing means and is actuated by operation through a hole in the cassette.

7. An ink ribbon cassette in accordance with claim 5, wherein said pressing force switching device is disposed facing said ink transfer roller via said ink ribbon, and presses said ink transfer roller against said ink-impregnated body by a pressing force that is increased upon actuation of said snap action spring.

8. An ink ribbon cassette in accordance with claim 7, wherein:

said pressing force switching device comprises two springs supported by substantially the same fulcrums, the cassette is provided with a first opening 35 in front of said two springs, and one of said springs is disposed on the outside of the other spring and provided with a second opening smaller than said first opening, said second opening being for increasing contact pressing force of said ink transfer roller against said ink-impregnated body by actuation of the other of the two springs disposed interiorly of the other spring, and said first opening being for further increasing contact pressing force of said ink transfer roller against said ink-impregnated body by actuation of said one of the two springs.

* * * * *